United States Patent [19]

Newton, Jr.

[11] Patent Number: 4,611,803

[45] **Date of Patent: * Sep. 16, 1986**

[54] STARTING BLOCK ASSEMBLY

[76] Inventor: Milton A. Newton, Jr., 4392 Pampas Rd., Woodland Hills, Calif. 91364

[ * ] Notice: The portion of the term of this patent subsequent to Dec. 31, 2002 has been disclaimed.

[21] Appl. No.: 603,788

[22] Filed: Apr. 25, 1984

Related U.S. Application Data

[63] Continuation-in-part of Ser. No. 510,203, Jun. 29, 1983, Pat. No. 4,561,650.

[51] Int. Cl.[4] ..... A63B 69/00

[52] U.S. Cl. ..... 272/105

[58] Field of Search ..... 272/105, DIG. 4; 403/339, 8; 273/162 A, 162 C

[56] References Cited

U.S. PATENT DOCUMENTS

| | | | |
|---|---|---|---|
| 1,130,610 | 3/1915 | Kane | 403/339 |
| 1,520,113 | 12/1924 | Bloom | 273/162 A |
| 3,724,843 | 4/1973 | Fichter et al. | 272/105 |
| 4,089,519 | 5/1978 | Newton | 272/105 |
| 4,124,317 | 11/1978 | Dauth | 403/8 |

FOREIGN PATENT DOCUMENTS

| | | | |
|---|---|---|---|
| 2507468 | 9/1976 | Fed. Rep. of Germany | 272/105 |
| 1527786 | 6/1968 | France | 272/105 |

*Primary Examiner*—Richard J. Apley
*Assistant Examiner*—S. R. Crow
*Attorney, Agent, or Firm*—Howard L. Johnson

[57] ABSTRACT

A portable starting block assembly for a track runner wherein the central alignment bar is formed in half-length segments for side-by-side lodgment during traveling, plus quick coupling means to fasten together the pieces during use. Also carries holding means for each anchorage pin against a block during non-use. The underface of the bar is formed with a lengthwise channel to receive an electric cable connecting an electronic reception unit at the rear with a front-end audio unit such as a start-signal microphone.

4 Claims, 13 Drawing Figures

STARTING BLOCK ASSEMBLY

This is a continuation-in-part of Ser. No. 510,203 filed June 29, 1983, now U.S. Pat. No. 4,561,650, issued Dec. 31, 1985.

BACKGROUND

Many runners who compete at successive track locations carry their own starting block assemblies with them. While the whole may be transported on the floor or in the trunk of a car, it becomes even more unwieldly when moving it by train, bus or moped. Consequently it would be desirable if the central alignment bar at least, coul be segmented so as to have its partial lengths carryable in a short handbag or placed in the carrier of a bicycle or the like. The persistant problem of course is to achieve a multiple piece assembly which is quick and readily assembled to a rigid form.

STATEMENT OF THE INVENTION

The invention provides a starting block assembly wherein the central alignment bar (to each side of which a triangular foot contact block is detachably coupled) is separable into at least two pieces or half-lengths, which pieces by longitudinal thrust-engagement tongue and clamp means can be readily reassembled. In addition, the long dirt anchorage pin provided for each end of the alignment bar now has a storege retention element on each respective starting block. Further, the alignment bar is formed with a longitudinal, open face channel for reception of an electric cable adapted to link a forward audio unit with a rear electronic reception unit. Such units, together with the linkage cable may be attached to the assembly at the time of track use and uncoupled for storage or transport.

DETAILED DESCRIPTION OF PREFERRED EMBODIMENT.

Figure 3:
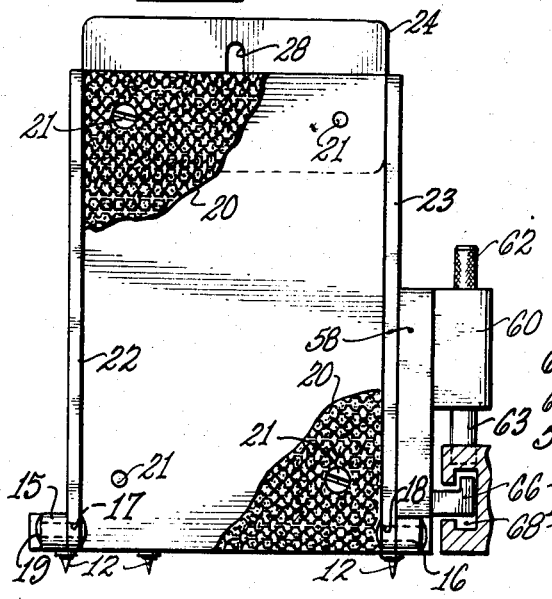
FIG. 3 is an end elevational view as seen from the left of FIG. 2, showing the block coupled to the alignment bar.
Figure 4:
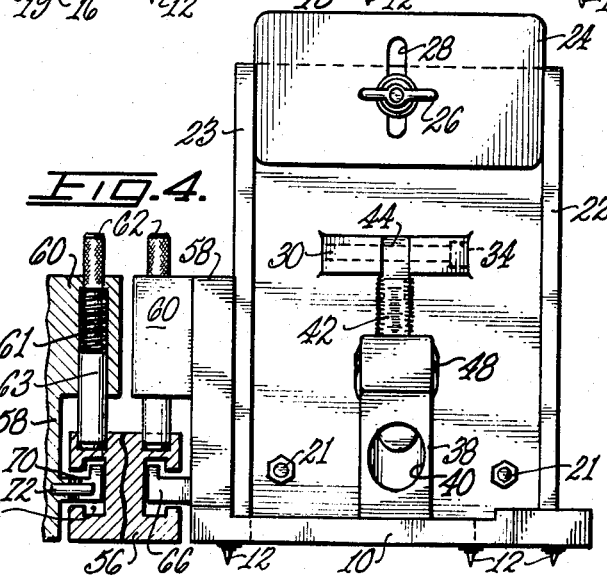
FIG. 4 is an end elevational view as seen from the right of FIG. 2 with the alignment bar coupled to a pair of blocks, partly in vertical section.
Figure 7:
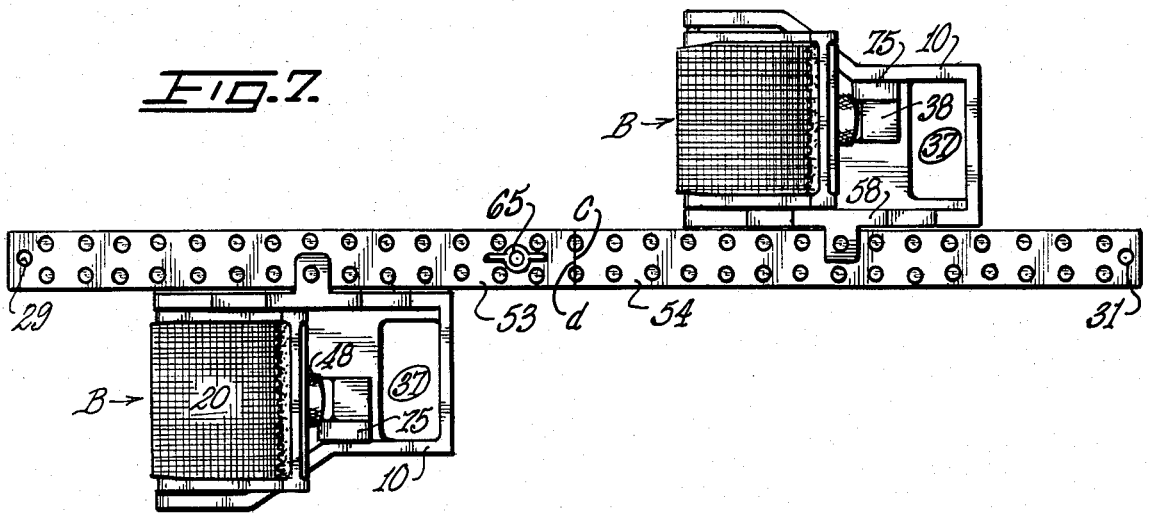
FIG. 7 is a top plan view of a complete Starting Block Assembly.

The invention provides a starting block B having a generally flat-bottom casting or base plate 10 which on its underface may carry downward extending spikes 12 for anchorage penetration of underlying ground or turf. Pivotally attached to the forward edge of the base plate is a somewhat concave, foot contact plate 14. Forming corners of the base plate are a pair of hinge/bearing tubes 15, 16 FIG. 3 located along its lower margin and aperture-aligned with corresponding bores 17, 18 of the edge rim of the base plate. Each pair of the two thus aligned socket tubes are held together by a transverse hinge pin 19. The concave forward face of the contact plate 14 may seat a corresponding contact pad 20, adhesively attached or press fit between the respective edge rims 22, 23; alternately or in addition the contact pad may be bolted to the surface of the tilted face by fasteners 21. Conveniently such pad is formed of resilient material such as natural and/or synthetic rubber, synthetic plastic or other cushioning material including natural fiber.

Extending across the upper margin of the foot contact plate 14 is a metal extension plate 24 adjustably held in juxtaposition with the rear face of the plate by a wing nut 26 or similar fastener which has its threaded shaft received through a vertical slot 28 of the extension plate. When the nut 26 is loose, the extension plate can be slid upward to such position as to support the instep or heel area of the particular user's show (and there tightened). Alternately, it can be pushed downward so as to be completely covered by the contact plate, as when the user does not desire to use it at all, or when storing or carrying the unit.

Figure 6:
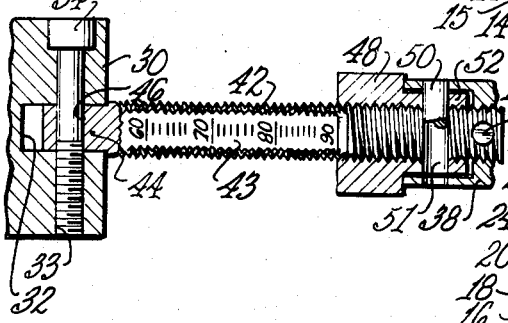
FIG. 6 is a detail view in longitudinal section of the elevating mechanism particularly showing the terminal connections of the threaded shaft.
Figure 1:
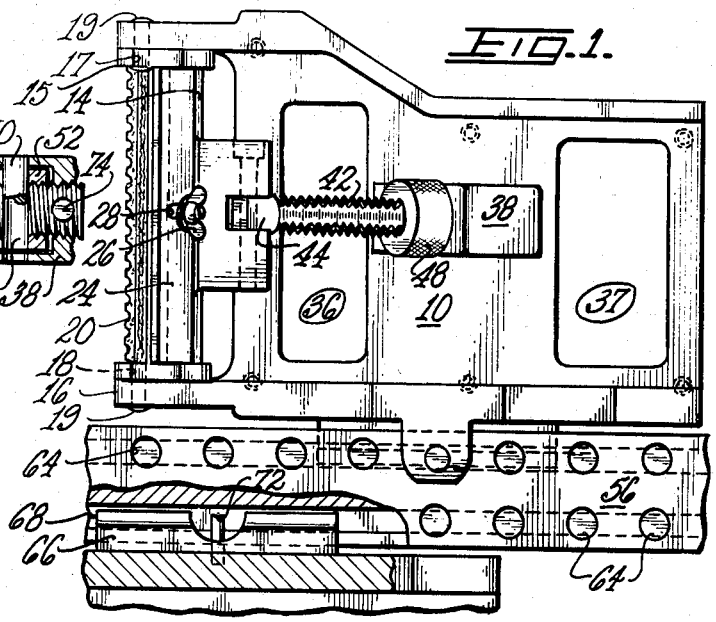
FIG. 1 is a plan view of one starting block and fragmental attachment portion of another, connected in longitudinally staggered relation to a central alignment bar or frame.

Projecting from the rear face of the contact plate 14 is a bifurcate coupling attachment 30 formed with a rear-opening tongue-slot 32 (FIG. 6) and a transverse bore 33 which receive a pivot pin 34 which traverses both the bifurcate structure and its slot 32.

Figure 5:
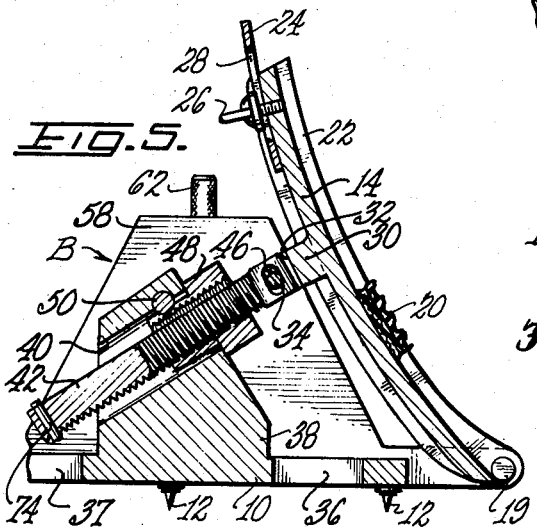
FIG. 5 is a longitudinal vertical section through a starting block, particularly showing the elevation mechanism.
Figure 2:
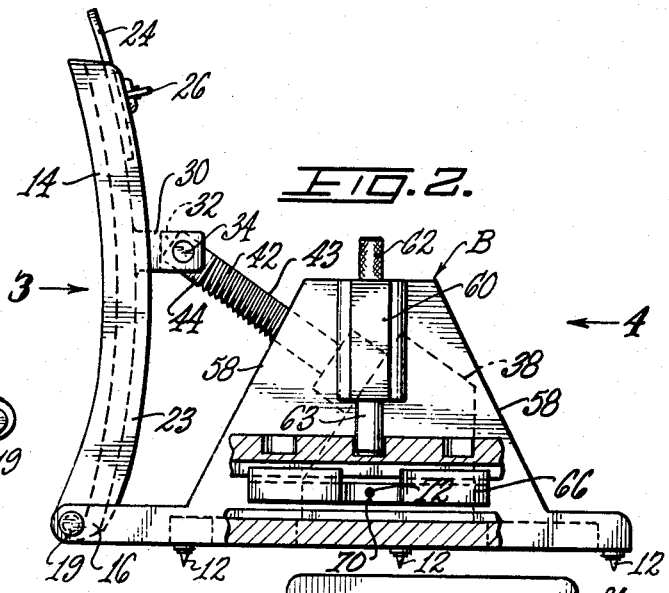
FIG. 2 is a side elevational view of an alignment-bar-attached starting block in vertical longitudinal section with the foot contact plate shown in maximum forward extension.

The base plate 10 is cast with two open areas 36, 37 and a central upstanding support post or tower 38 which latter has a forwardly upslanted, smooth bore or channel 40. The coupling attachment 30 and the support post 38 are connected by a two-piece elevating or positioning mechanism including a threaded support shaft or screw 42 which is rendered non-rotatable by having a terminal flat-sided tongue 44 received in the coupling slot 32 and loosely held by a pin 34 inserted through a laterally enlarged aperture 46 (FIG. 5) which allows lateral movement of the pin so as to accommodate shift of the upslanted positions of the forward contact plate 14 between those shown in FIGS. 2 and 5. Such shift is effected by (manual) rotation of a nut 48 carried by the threaded shaft 42 and held against its own axial displacement by a transverse pin 50 (FIGS. 5-6) which traverses a bore of the tower 38 with its midlength riding in a circumferential groove 51 of a reduced neck 52 of the control nut 48. A longitudinal, flat-top length or surface 43 of the threaded, support shaft carries numerical indicia indicating the corresponding degrees of elevation, between extreme end positions, of the foot plate 14. Thus the fixed pin 50 seated in the peripheral groove 51 provides restraining means against lengthwise travel of the nut along the shaft and causes the latter to move lengthwise instead in the channel 40 so as to bring the pivotally supported foot contact plate 14 to a selected tilt. The heart of the elevating mechanism is thus the two-piece positioning means consisting of interengaging screw 42 and nut 48 of which one piece is restrained from rotary movement in order to enable longitudinal movement of the other piece.

Each pair of starting blocks, along one side carries attachment means for its coupling to a central alignment frame or rod 56. Located along one side margin of the base plate 10, depending on whether it is made for right or left side attachment, is an upstanding wall 58. Along its outer side it carries a tubular housing 60 for a spring-loaded 61 attachment pin 62 which extends beyond both ends of the housing, so that its lower end is insertable in a selected one of a series of upward-opening sockets 64 which are spaced a unit distance apart (e.g. one inch or 2.5 cm.) along the top surface of the frame 56. From the lower outer margin of the lateral wall 58 projects an L-shaped runner 66 which is lengthwise movable along a T-shaped, lengthwise slideway 68 of the frame. Such a T-apertured frame and corresponding block attachment means are shown in my earlier cited patent. However the present starting block may be modified for coupling to any other alignment frame or rod which is available, and its usage is not limited to its usage with the here illustrated alignment frame 56.

The runner 66 may be cast integral with the base plate 10 or, when formed of a different metal, such as brass, may be bolted or otherwise fastened thereto. It is formed with a central cut-out area 70 from which a stop pin 72 projects so as to support the contact end 63 of the attachment pin 62 when not received in a socket 64. At the lower end of the threaded shaft 42, a diametrically projecting stop pin 74 prevents complete (forward) withdrawal of the shaft 42 from the (post-retained) nut.

Figure 11:
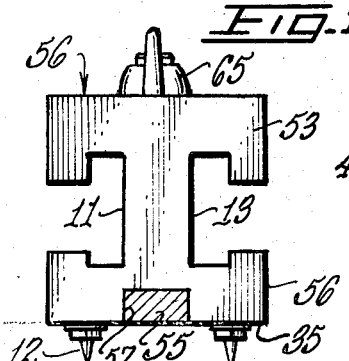
FIG. 11 is an end elevational view of the assembly.
Figure 12:
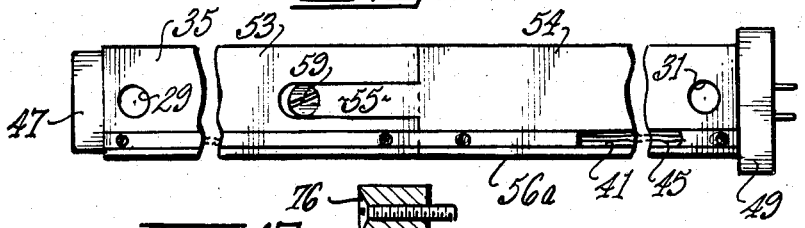
FIG. 12 is a bottom plan view of a modification having a lengthwise channel carrying an electric cable between terminal coupling units.
Figure 13:
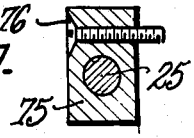
FIG. 13 is a vertical section through a holding block embracing a dirt pin.

As seen particularly in FIGS. 7–12, the elongated, rectangular alignment bar 56 is formed with two parallel, lengthwise, side-open, T-shaped slideways 11, 13, FIG. 11. Along the upper face are two lengthwise lines of unit-separated, vertical sockets 64 which open into the upper T portion of the respective slideways. At each end the bar is bored vertically to receive a dirt anchorage pin 25, 27, and spaced therebetween, shorter spikes 12 may be secured along the length. The underface 35 of the bar is formed with an offcenter, lengthwise, open-face channel 41 in which may be temporarily placed, such as prior to usage on a track, an electric cabel 45 which serves to connect a speaker or audio unit 47 at the front, with a short wave recorder/receiver 49 at the rear end of the bar; these may be coupled to the alignment bar at times when they are required, and at other times left off.

The alignment bar 56 is formed of two separate pieces or half lengths 53, 54 having detachable alignment and coupling means for holding their mutually parallel, end faces c, d firmly together in face-to-face abutment. One piece 54 is formed with a longitudinal tongue or bayonet extension 55 of lesser width than the bar 56 and adapted for insertion in a corresponding shaped slot or groove 57 of the adjacent piece 53. The tongue is held in place by a flat-ended, vertically upstanding screw 59 which at its upper end is anchored by a wing nut 65. If the bore 67 is threaded to engage the screw 59, the wing nut can be omitted.

Figure 8:
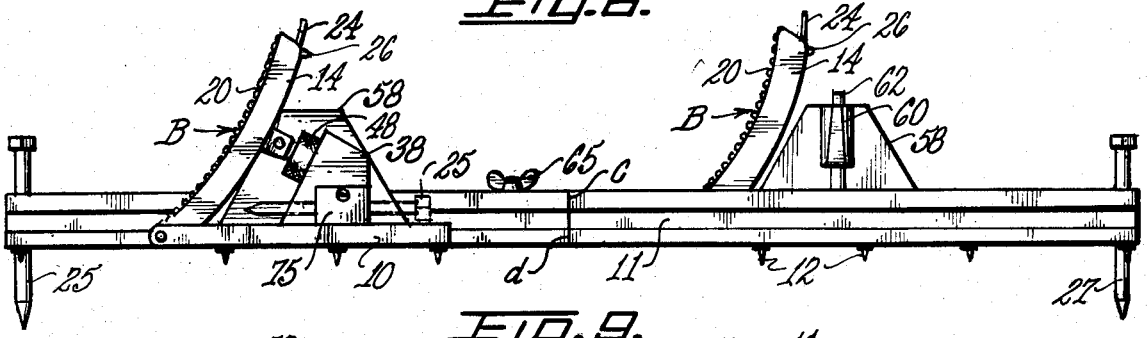
FIG. 8 is a side elevational view of the assembly of FIG. 7.
Figure 9:
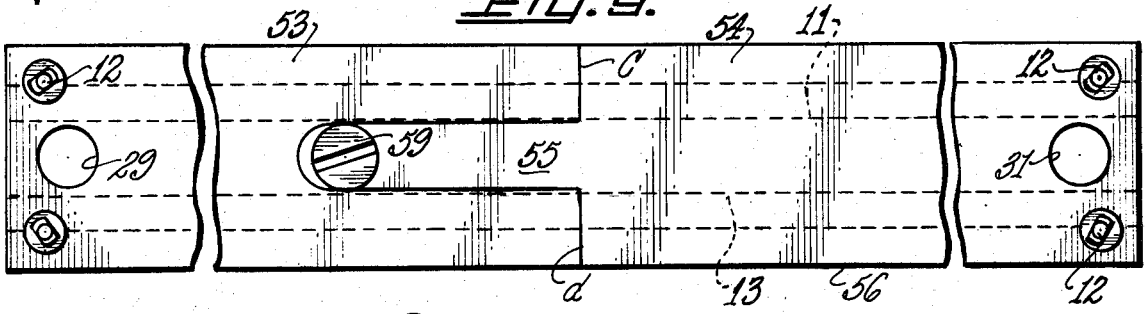
FIG. 9 is an enlarged bottom plan view of the assembly with portions of the lengths broken away.
Figure 10:
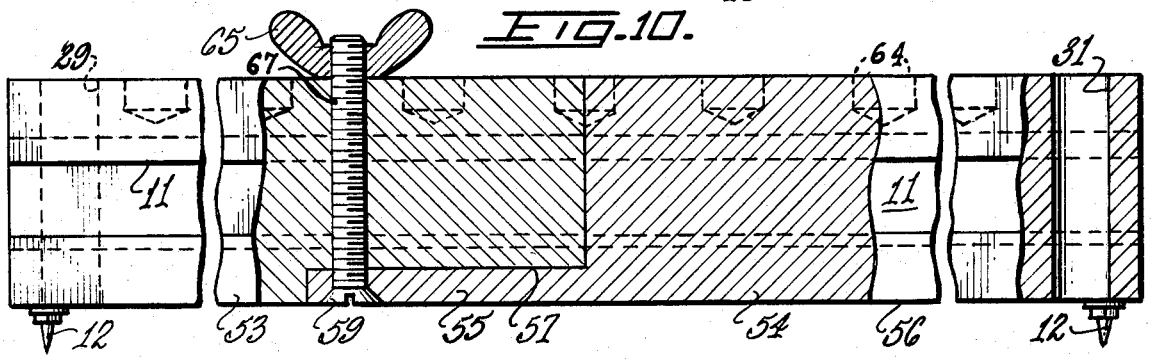
FIG. 10 is a vertical longitudinal sectional view through the assembly with a portion in vertical section.

Each base plate 10 carries holding means for one anchorage pin 25, 27 when not located in an end socket 29, 31. This consists of a holding block 75 formed with a generally horizontal aperture adapted to lengthwise receive and hold relatively snugly the shaft of an anchorage pin 25, 27 inserted by a part of its length therethrough (FIG. 8). Such block 75 may simply be a piece of resilient, synthetic plastic material such as "teflon" wherein the aperture or bore has a circumference slightly less than that of the anchorage pin 25 so that the inserted pin is snugly grasped and retained. The block is fastened to the support post 38 by a screw 76.

I claim:

1. A starting block assembly comprising, in combination:

an elongated alignment bar adapted for location at the start of a running track, said bar having means for selective attachment of a starting block adjacent each side thereof, said bar being formed of two elongated pieces joinable end-to-end at a point intermediate its assembled length and having clamp means for holding the pieces together in functional position, whereby the pieces may be separated from each other and thus rendered portable for storage and traveling, and a pair of starting blocks each having means for selective attachment to a respective side of the assembled length of said bar and at least one of said starting blocks comprising a base plate and a forward facing foot contact place disposed pivotally upstanding from a leading edge of the base plate, said base plate carrying selectively adjustable, elevating mechanism adapted to progressively tilt and hold the foot contact plate at a selected tilt between upstanding and reclined positions, said elevating mechanism comprising support means carried by the base plate including elongated, two-piece positioning means having an upslanted forward end pivotally connected to a rear surface of the foot contact plate, one piece of said positioning means comprising a threaded shaft and the other piece comprising an operating nut threadedly carried by said shaft, one of said pieces being lengthwise displaceable relative to the other when the other is held stationary, whereby rotation of the rotatable piece may effect extension or contraction of said positioning means toward or away from the pivotally connected foot contact plate so as to determine the tilt of said foot contact plate and to support it from the rear so as to oppose back pressure of a user's foot when pressed against the forward face of the foot contact plate.

2. A starting block assembly according to claim 1 wherein said alignment bar has socket means for reception of an anchorage pin adjacent each end of the bar, a pair of dirt anchorage pins adapted for functional retention in said socker means, and resilient, snug tubular holding means for selectively attaching each anchorage pin to the assembly in carrying position when removed from said socket means.

3. A starting block assembly according to claim 1 wherein an underface of said alignment bar is formed with a lengthwise open channel adapted for selective reception of an electric cable extending between the respective ends of said bar so as to position the cable to connect respective audio and electronic units which may be located adjacent ends of the bar.

4. A starting assembly according to claim 1 wherein said clamp means includes a thrust-engagement tongue extending from one of said pieces positioned for coupling engagement with an insertion socket which is formed in the other of said pieces.

* * * * *